United States Patent [19]

Tanaka

[11] Patent Number: 4,736,178

[45] Date of Patent: Apr. 5, 1988

[54] LEAD-OUT ARRANGEMENT FOR AN ELECTROMAGNETIC SWITCH

[75] Inventor: Toshinori Tanaka, Himeji, Japan

[73] Assignee: Mitsubishi Denki Kabushiki Kaisha, Japan

[21] Appl. No.: 37,797

[22] Filed: Apr. 13, 1987

[30] Foreign Application Priority Data

Apr. 16, 1986 [JP] Japan ..... 61-87389

[51] Int. Cl.[4] ..... H01F 5/00

[52] U.S. Cl. ..... 335/299; 336/192

[58] Field of Search ..... 335/255, 282, 299; 336/192

[56] References Cited

U.S. PATENT DOCUMENTS

| | | | |
|---|---|---|---|
| 3,509,505 | 4/1970 | Zagrzjewski | 335/274 |
| 3,571,770 | 3/1971 | Dow | 335/256 |
| 4,423,399 | 12/1983 | Goodrich | 336/192 X |
| 4,639,706 | 1/1987 | Shimizu | 336/192 X |

*Primary Examiner*—George Harris

*Attorney, Agent, or Firm*—Leydig, Voit & Mayer

[57] ABSTRACT

A lead-out arrangement for an electromagnetic switch is disclosed which is capable of substantially preventing injury or damage to the covering film or insulating layer on the lead-out end of an exciting coil without enlarging the size of the electromagnetic switch. The electromagnetic switch includes a bobbin having a cylindrical portion and a pair of flanges formed at the opposite ends of the cylindrical portion, an iron core inserted into the bobbin from its one end and having an end wall in intimate contact with the outer peripheral surface of one of the bobbin flanges at the opposed end of the bobbin, and an exciting coil wound around the bobbin. A notch is formed in the iron core end wall and a projected guide wall extends outwardly from the one bobbin flange through and along the notch, the thickness of the iron core end wall being reduced at a portion thereof adjacent the notch. The projected guide wall is connected with the one bobbin flange through a connecting portion which is intimately secured to and extends along the thickness-reduced portion of the iron core end wall so as to smoothly guide the lead-out end of the exciting coil at a relatively large radius of curvature.

9 Claims, 3 Drawing Sheets

LEAD-OUT ARRANGEMENT FOR AN ELECTROMAGNETIC SWITCH

BACKGROUND OF THE INVENTION

1. Field of the Invention

This invention relates to an electromagnetic switch, and more particularly, to an improvement in a lead-out arrangement for leading out one end of a coil wound around a bobbin of the electromagnetic switch.

2. Description of the Prior Art

In the past, various electromagnetic switches have been well known, a typical example of which is described in Japanese Utility Model Laid-Open No. 56-37318 (1981). The general arrangement of such a conventional electromagnetic switch is illustrated in FIG. 5. The electromagnetic switch illustrated includes a cylindrical outer casing 1 closed at one end by an end wall 1*a* and open at the other end. The end wall 1*a* of the outer casing 1 has a central opening through which a plunger 2 is inserted into the casing 1 for axial sliding movement relative thereto. Disposed at the open end of the outer casing 1 is a stationary iron core 3 in a face-to-face relation with the plunger 2, the stationary iron core 3 having an end wall 3*a* which is fitted into and fixedly secured to the inner periphery of the casing open end so as to constitute a switch housing for receiving a coil bobbin 4 therein. The coil bobbin 4 is formed of synthetic resin, and has a cylindrical member 4*a* and a pair of annular flanges 4*b* integrally formed with the cylindrical member 4*a* at its opposite ends in such a manner as to oppose the end wall 1*a* of the outer casing 1 and the end wall 3*a* of the iron core 3, respectively.

An exciting coil 5 is wound around the bobbin 4 and adapted to magnetize, upon energization thereof, the iron core 3 received therein so that the iron core 3 thus magnetized acts to magnetically attract the plunger 2. A return spring 6 is disposed under compression between the iron core 3 and the plunger 2 for biasing the plunger 2 in a direction away from the iron core 3. Inserted into a through-hole formed through the iron core 3 at its central portion is a rod 8 which has a movable contact 7 at its tip end. A contact cap 9 formed of an electrically insulating material is fixedly attached by caulking to the open end of the outer casing 1 together with the end wall 3*a* of the iron core 3.

The conductive wire of the exciting coil 5 wound around the bobbin 4 has one end extending to the outside from a lead-out portion 10 formed over one of the bobbin flanges 4*b* and the iron core end wall 3*a* through an eyelet 12 which serves to secure a terminal 11 to the contact cap 9. As clearly shown in FIGS. 6 and 7, the lead-out portion 10 is comprised of a pair of projected guide walls 4*c* integrally formed with and extending axially outwardly from the bobbin flange 4*b* along a notch 3*b* formed in the iron core end wall 3*a*. The projected guide walls 4*c* are connected with the bobbin flange 4*b* through connecting corner portions, each of which is tapered or chamferred at 4*d* as pictured in FIGS. 6 through 8 so as to prevent injury or damage to the covering film or insulating layer on the surface of the lead-out end of the conductive wire of the exicting coil 5.

With the lead-out portion 10 of the conventional electromagnetic switch as constructed above, however, the corners connecting beteen the projected guide walls 4*c* and the bobbin flange 4*b* are merely tapered or chamferred at 4*d* over a relatively small area so that the lead-out end 5*a* of the coil wire is forced to curve or bend at the connecting corners with a relatively small radius of curvature. As a result, there is the great possibility of the covering film or insulating layer on the coil wire lead-out end being injured or damaged, and hence the conventional lead-out portion 10 is not satisfactory.

On the contrary, it has been considered to increase the thickness of the bobbin flange 4*b* in order to taper or chamfer the connecting corners of the lead-out portion 10 over a relatively larger area so as to permit the lead-out end 5*a* of the coil wire to curve at a relatively large radius of curvature. In this case, however, there is the problem that the entire length of the bobbin 4 would become greater, thus increasing the size of the electromagnetic switch itself. On the other hand, it has further been considered to reduce the thickness of the iron core end wall 3*a* by the increased amount of thickness of the bobbin flange 4*b*. In this case, as the plunger 2 is magnetically drawn toward the iron core 3 under the action of magnetic attraction force which is generated by a magnetic circuit passing through the outer casing 1, the end wall 3*a* and the cylindrical body of the iron core 3, and the plunger 2 when the exciting coil 5 is energized, as shown by a dotted line 13 in FIG. 5, if the cross sectional area of the magnetic circuit 13 is reduced at the thinner iron core end wall 3*a*, the magnetic resistance will increase at that location, thus posing a problem in that the size of the exciting coil 5 would have to be enlarged so as to produce greater magnetomotive force to compensate for the increased magnetic resistance.

Thus, in the conventional lead-out arrangement as described above, it is difficult to lead out the end of the conductive wire of the exciting coil 5 by permitting it to curve at a relatively large radius of curvature, and to cope with this, the tapered or chamferred area at the connecting corners between the projected guide walls 4*c* and the bobbin flange 4*b* is enlarged as much as possible. With this measure, however, the possibility of injury or damage to the covering film or insulating layer on the coil wire lead-out end is not practically reduced, and such a measure is still not satisfactory.

SUMMARY OF THE INVENTION

In view of the above, the present invention is intended to obviate the above-described problems of te prior art, and has for its object the provision of a novel and improved lead-out arrangement for an electromagnetic switch which is capable of substantially preventing injury or damage to the covering film or insulating layer on the lead-out end of an exciting coil without enlarging the size of the electromagnetic switch.

In order to achieve the above object, according to the present invention, in an electromagnetic switch comprising a bobbin having a cylindrical portion and a pair of flanges formed at the opposite ends of the cylindrical portion, an iron core inserted into the bobbin from its one end and having an end wall in intimate contact with the outer peripheral surface of one of the bobbin flanges at the opposed end of the bobbin, and an exciting coil wound around the bobbin, there is provided a lead-out arrangement for leading out one end of the exciting coil through the one bobbin flange and the end wall of the iron core, the lead-out arrangement including a notch formed in the iron core end wall and a projected guide wall extending outwardly from the one bobbin flange through and along the notch, the thickness of the iron core end wall being reduced at a portion thereof adjacent the notch, the projected guide wall being connected with the one bobbin flange through a connecting portion which is intimately secured to and extends along the thickness-reduced portion of the iron core end wall so as to smoothly guide the lead-out end of the exciting coil.

In one embodiment, the thickness-reduced portion of the iron core end wall adjacent the notch is tapered.

In another embodiment, the thickness-reduced portion of the iron core end wall adjacent the notch has an inwardly directed recess formed on the inner surface of the iron core end wall.

It is preferable that the connecting portion between the projected guide wall and the bobbin flange have a tapered surface of a relatively small gradient or a curved surface of a relatively large radius of curvature.

According to the electromagnetic switch as constructed above, the thickness of only a portion of the iron core end wall adjacent the notch formed therein is reduced so that the connecting portion between the projected guide wall and the bobbin flange can be formed as a tapered or curved surface having a relatively small gradient or a relatively large radius of curvature as compared with a small chamferred corner of a conventional lead-out portion as previously referred to at the outset. As a result, a lead-out end of the exciting coil can be smoothly curved along the connecting portion with a relatively large radius of curvature, whereby damage or injury of a covering film or an insulating layer on the lead-out end of the coil can be prevented in a most effective manner. Moreover, the thickness of almost all of the iron core end wall other than only a limited portion thereof adjacent the notch is not reduced but remains unchanged so that a magnetic circuit, generated upon excitation of the coil to pass through the iron core end wall, is not affected at all in terms of its cross sectional area and hence magnetic resistance. Accordingly, it is not necessary to increase the magnetomotive force of the exciting coil to produce a prescribed level of magnetic attraction force, and there is no need for increasing the thickness of the iron core end wall so as to reduce the magnetic resistance, thus avoiding an increase in dimensions of the entire electromagnetic switch.

The above and other objects, features and advantages of the present invention will become apparent from the following detailed description of a few presently preferred embodiments of the invention when taken in conjunction with the accompanying drawings.

BRIEF DESCRIPTION OF THE DRAWINGS

FIGS. 3 and 4 show a further modified form of a lead-out arrangement in accordance with the present invention, in which FIG. 3 is a perspective view showing an iron core having an annular end wall with a notch and an inwardly directed recess formed therein; and FIG. 4 is a perspective view of an essential part of the lead-out arrangement.

DESCRIPTION OF THE PREFERRED EMBODIMENTS

The present invention will now be described with reference to a few presently preferred embodiments thereof as illustrated in the accompanying drawings. In the following description, the same or corresponding portions or elements of the embodiments are identified by the same refernce numerals as employed in FIGS. 5 through 8.

Figure 1A:
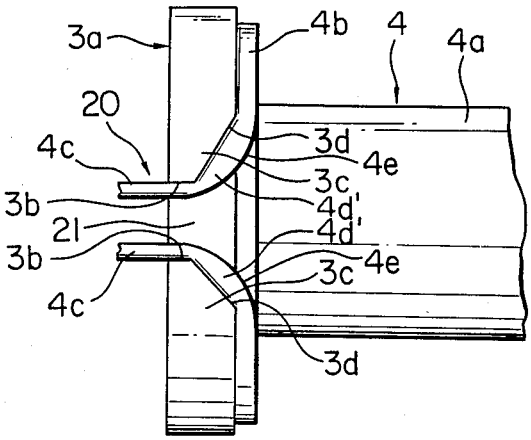
FIG. 1A is a side elevational view of a lead-out arrangement for an electromagnetic switch for leading out one end of an exciting coil in accordance with the present invention.
Figure 1B:
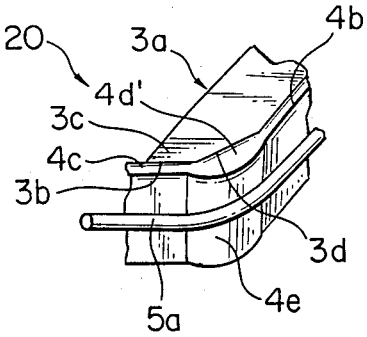
FIG. 1B is a perspective view of an essential part of the lead-out arrangement illustrated in FIG. 1B.
Figure 2:
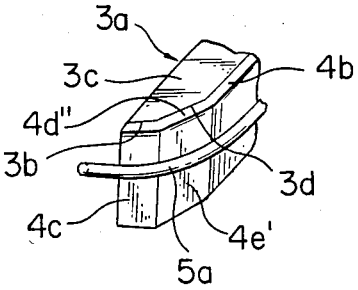
FIG. 2 is a view similar to FIG. 1B, but showing a modified form of a lead-out arrangement in accordance with the present invention.
Figure 5:
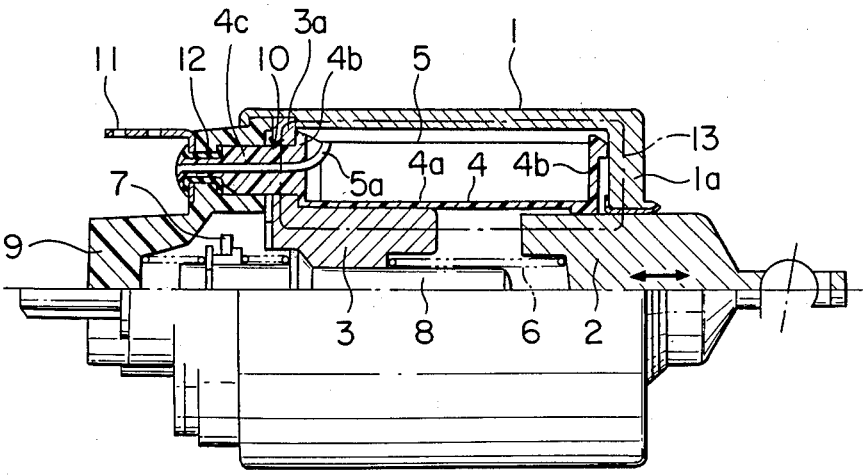
FIG. 5 PRIOR ART
FIG. 5 is a side elevational view of a conventional electromagnetic switch with the upper half portion vertically sectioned.
Figure 6:
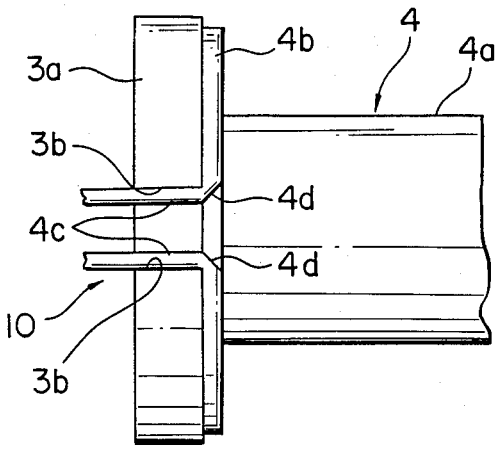
FIG. 6 PRIOR ART
FIG. 6 is a side elevational view of a lead-out arrangement of the electromagnetic switch illustrated in FIG. 5.
Figure 7:
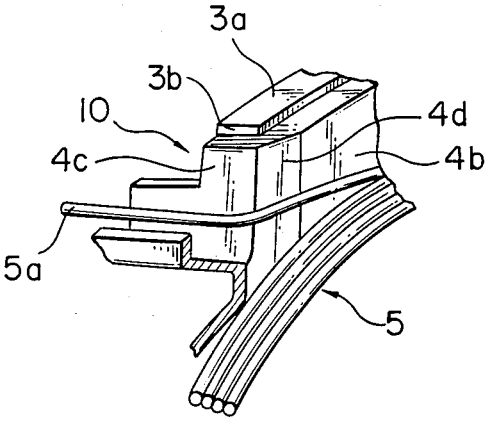
FIG. 7 PRIOR ART
FIG. 7 is a perspective view of an essential part of the lead-out arrangement illustrated in FIG. 6.
Figure 8:
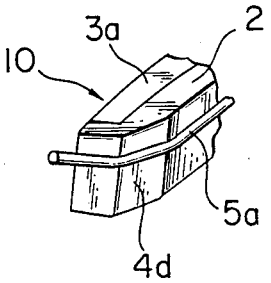
FIG. 8 PRIOR ART
FIG. 8 is a perspective view showing another form of a conventional lead-out arrangement for an electromagnetic switch.

Referring first to FIGS. 1 and 2, there is shown a lead-out arrangement for an electromagnetic switch which is constructed in accordance with the present invention and which is applicable to the conventional electromagnetic switch illustrated in FIG. 5. As illustrated in FIG. 1, the lead-out arrangement for leading out one end of an exciting coil, generally designated by reference numeral 20, includes a notch 21 formed in an annular end wall 3*a* of an iron core, and a pair of projected guide walls 4*c* (only one may be satisfactory) extending outwardly from one of bobbin flanges 4*b* (the other is not illustrated) through and along the notch 21. The iron core end wall 3*a* has its opposed side portions 3*c* adjacent the notch 21 tapered at 3*d* at its inner corners so as to reduce the thickness thereof.

Each of the projected guide walls 4*c* is connected with the one bobbin flange 4*b* through a connecting portion 4*d*′ which is in close contact with and extends along the tapered surfaces 3*d* of the thickness-reduced side portions 3*c* of the iron core end wall 3*a*. As illustrated in FIGS. 1A and 1B, the inner corner of each of the opposed side portions 3*c* is tapered over a relatively large area so as to reduce the thickness thereof as referred to above, so that each of the connecting portions 4*d*′ can have a smoothly curved convex surface 4*e* having a relatively large radius of curvature for smoothly guiding the lead-out end 5*a* of an exciting coil (not shown) without formation of any sharp bend.

As illustrated in FIG. 2, the connecting portion 4*d*″ between the projected guide wall 4*c* and the bobbin flange 4*b* may have a flat tapered surface 4*e*′ in place of the curved convex surface 4*e*.

Figure 3:
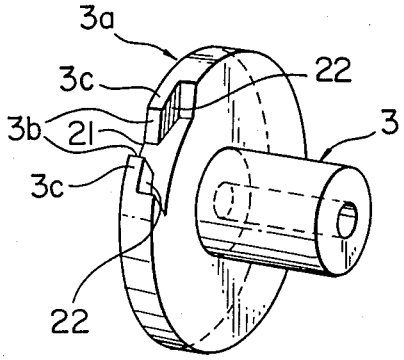
Figure 4:
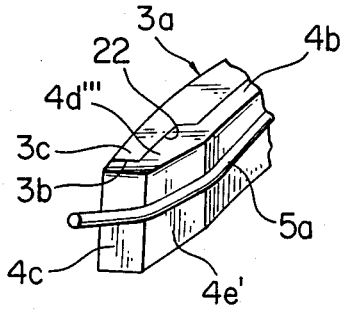

FIGS. 3 and 4 show a modified form of a lead-out arrangement according to the present invention. In FIG. 3, there is illustrated an iron core 3 having an annular end wall 3*a* integrally formed at its one end, the annular end wall 3*a* being notched at 21 and having a pair of inwardly directed or opened recesses 22 (only one may be satisfactory) formed in the inner surface thereof at the opposed side portions 3*c* so as to reduce the thickness thereof. As partially shown in FIG. 4 on an enlarged scale, a pair of projected guide walls 4*c* (only one is illustrated in FIG. 4) are each integrally formed with and extend axially from a bobbin flange 4*b* through the intermediary of a connecting portion 4*d*‴ which has one side surface configured so as to conform to the corresponding one of the recesses 22 to be received therein in close contact with the inner surface of the corresponding one of the notched side portions 3c of the iron core end wall 3a. The connecting portion 4d''' has a tapered surface 4e' of a relatively large area or a small gradient formed on the other inwardly facing side so as to smoothly guide a lead-out end 5a of an exciting coil without formation of any sharp bend. In this connection, however, the connecting portion 4d''' may have a smoothly curved convex surface in place of the tapered surface.

It should be noted that in the above-described embodiments, the thickness of a portion of the iron core end wall 3a (i.e., the opposed side portions 3c) adjacent the notch 21 is appropriately reduced so that the connecting portion 4d', 4d'', or 4d''' connecting between the projected guide wall 4c and the bobbin flange 4b and disposed in close contact with the thickness-reduced portion of the iron core end wall 3a, can have an inwardly-facing (in relation to the outer casing 1) curved surface 4e of a relatively large radius of curvature or an inwardly-facing tapered surface of a relatively large area or a relatively small gradient. Accordingly, the lead-out end 5a of the exciting coil can be curved or guided along the curved or tapered surface 4e or 4e' of the connecting portion 4d', 4d'', or 4d''' at a relatively large radius of curvature without forming any sharp bend, thereby substantially preventing damage or injury to the covering film on the lead-out end 5a of the exciting coil.

Further, the thickness of theiron core end wall 3a is reduced only at a portion thereof, and the thicknss of almost all the remaining portion of the end wall 3a other than the thickness-reduced portion remains unchanged so that there will be substantially little or no effects on the cross sectional area or the magnetic resistance of a magnetic circuit which is generated by excitation of the coil to pass through the iron core end wall 3a. As a result, there is no need to increase the magnetomotive force of the exciting coil so as to produce a prescribed level of magnetic attraction force, and hence it is possible to avoid an enlargement in the overall size of the electromagnetic switch.

What is claimed is:

1. In an electromagnetic switch comprising:

a bobbin having a cylindrical portion and a pair of flanges formed at the opposite ends of said cylindrical portion;

an iron core inserted into said bobbin from its one end and having an end wall in intimate contact with the outer peripheral surface of one of said bobbin flanges at the opposed end of said bobbin; and an exciting coil wound around said bobbin;

a lead-out arrangement for leading out one end of said exciting coil through said one bobbin flange and said end wall of said iron core, said lead-out portion including a notch formed in said iron core end wall and a projected guide wall extending outwardly from said one bobbin flange through and along said notch, the thickness of said iron core end wall being reduced at a portion thereof adjacent said notch, said projected guide wall being connected with said one bobbin flange through a connecting portion which is intimately secured to and extends along said thickness-reduced portion of said iron core end wall so as to smoothly guide the lead-out end of said exciting coil.

2. A lead-out arrangement as set forth in claim 1, wherein said thickness-reduced portion of said iron core end wall adjacent said notch is tapered.

3. A lead-out arrangement as set forth in claim 1, wherein said thickness-reduced portion of said iron core end wall adjacent said notch has an inwardly directed recess formed on the inner surface of said iron core end wall.

4. A lead-out arrangement as set forth in claim 1, wherein said connecting portion between said projected guide wall and said bobbin flange has a tapered surface.

5. A lead-out arrangement as set forth in claim 1, wherein said connecting portion between said projected guide wall and said bobbin flange has a curved surface having a relatively large radius of curvature.

6. A lead-out arrangement as set forth in claim 2, wherein said connecting portion between said projected guide wall and said bobbin flange has a tapered surface.

7. A lead-out arrangement as set forth in claim 2, wherein said connecting portion between said projected guide wall and said bobbin flange has a curved surface having a relatively large radius of curvature.

8. A lead-out arrangement as set forth in claim 3, wherein said connecting portion between said projected guide wall and said bobbin flange has a tapered surface.

9. A lead-out arrangement as set forth in claim 3, wherein said connecting portion between said projected guide wall and said bobbin flange has a curved surface having a relatively large radius of curvature.

* * * * *